United States Patent [19]

Fitzner

[11] Patent Number: 4,463,743

[45] Date of Patent: Aug. 7, 1984

[54] CAPACITOR DISCHARGE IGNITION SYSTEM FOR INTERNAL COMBUSTION ENGINES

[75] Inventor: Arthur O. Fitzner, Fond du Lac, Wis.

[73] Assignee: Brunswick Corporation, Skokie, Ill.

[21] Appl. No.: 330,420

[22] Filed: Dec. 14, 1981

[51] Int. Cl.[3] ..... F02P 3/08

[52] U.S. Cl. ..... 123/599

[58] Field of Search ..... 123/599, 602, 605

[56] References Cited

U.S. PATENT DOCUMENTS 3,240,198 3/1966 Loudon et al. ..... 123/602

4,015,564 4/1977 Fitzner ..... 123/602

*Primary Examiner*—Tony M. Argenbright

*Attorney, Agent, or Firm*—O. T. Sessions

[57] ABSTRACT

The invention provides a modular ignition system using a separate ignition module (16) for each engine cylinder. The modules (16) can be arranged for use with engines having differing numbers of cylinders.

Each module (16) includes a main capacitor (22) to be charged by the engine's alternator (11). The main capacitor (22) is discharged through a main silicon controlled rectifier (23) into an ignition transformer (28) to provide a high voltage pulse to fire a spark plug (15). A pilot capacitor (26) is also charged by the alternator (11) to provide power to a pilot SCR (36). The pilot SCR (36) has its gate connected to a trigger winding (14) in the alternator (11) to discharge the pilot capacitor (26) into the gate of the main SCR (23) to fire the spark plug (15).

The pilot capacitor (26) is also connected to the cathode of the main SCR (23). This connection raises the voltage level of the pilot capacitor (26) during the discharge pulse to assure gate current to the main SCR (23) during the critical turn on period.

A biasing network including resistors (39, 40) and a bias capacitor (41) is provided in each of the modules (16) to maintain a substantially constant ignition angle, regardless of engine speed. The biasing networks can be interconnected to assure uniform timing for all of the spark plugs (15).

7 Claims, 3 Drawing Figures

CAPACITOR DISCHARGE IGNITION SYSTEM FOR INTERNAL COMBUSTION ENGINES

DESCRIPTION

Technical Field

This invention relates to a capacitor discharge ignition system and more particularly to such a system having a trigger circuit to discharge the capacitor.

BACKGROUND ART

A number of electronic ignition systems have been developed to provide spark ignition for internal combustion engines. Among them, capacitor discharge systems, in which a capacitor is charged to a relatively high voltage and then rapidly discharged by a thyristor such as a silicon controlled rectifier (SCR) through a step-up ignition transformer, have been highly satisfactory.

One such system is disclosed in U.S. Pat. No. 4,015,564 to the present inventor, entitled "Ignition System For Internal Combustion Engines Having Timing Stabilizing Means". In that system the main capacitor has one side connected to engine ground and the other side connected to the anode of the controlled rectifier. The cathode of the controlled rectifier is connected to the ignition transformer, the other side of which is grounded. A triggering circuit utlizes timed pulses generated in a trigger coil by a magnet coupled to the engine flywheel to trigger a pilot silicon controlled rectifier which in turn is transformer coupled to the gate of the main controlled rectifier to discharge the main capacitor. Such an arrangement is particularly useful where an electrically positive discharge pulse is desired since it allows the ignition transformer to use a common ground between its primary and secondary coils, and further, allows the triggering signals to be relative to ground. That system, however, required a trigger pulse transformer to couple the pilot SCR to the gate of the main SCR since the cathode of the main SCR discharges to the ignition coil.

A capacitor discharge ignition system disclosed in U.S. Pat. No. 3,739,759 to Sleder and entitled "Rotation Sensing Pulse Control Generator For Triggered Ignition Systems" shows a triggering system having a pilot SCR directly coupled to the gate of the main ignition SCR. In this system, however, the cathode of the main SCR is directly connected to ground and a negative output pulse is provided to the ignition transformer. Such a system would not be suitable where a positive output pulse is required, as for example, for use in the system described in the present inventor's copending U.S. Patent application Ser. No. 330,419, entitled "Capacitor Discharge Ignition System Having a Charging Control Means", filed on the same date as this application, now Pat. No. 4,433,668.

Another ignition system having a pilot SCR directly coupled to a main SCR is shown in U.S. Pat. No. 3,937,200 to Sleder and the present inventor entitled "Breakerless and Distributorless Multiple Cylinder Ignition System". That system uses two discharge circuits controlled by a single SCR. In one of the discharge circuits the anode of the SCR is connected through a diode to ground while the cathode is connected to an ignition transformer which in turn is connected through an energy-storage capacitor to ground. In this discharge circuit the cathode of the SCR will be charged negatively and rise to ground as the capacitor discharges. In the other discharge circuit the cathode of the SCR is connected through a diode to ground. Consequently, the cathode of the SCR cannot rise above ground to inhibit the gate signal. This arrangement, however, maintains a negative potential for substantial periods of time on the trigger coil. Thus, any inadvertent leakage in the trigger coil circuit could cause untimely triggering of the discharge circuit. Further, the system does not permit the ignition transformers to use a common grounded connection between the primary and secondary coils.

DISCLOSURE OF INVENTION

In accordance with the present invention a capacitor discharge ignition system for an internal combustion engine includes a connection means having a stator input terminal, a trigger input terminal, a ground terminal, and an output terminal. A main capacitor is connected between the stator input terminal and the ground terminal to be charged through a charging diode in response to a first specific polarity signal. A main gated switch, having its anode connected to the main capacitor and its cathode connected to the output terminal, controls the discharge of the main capacitor to the load, i.e., the ignition transformer, connected between the output terminal and ground. A pilot gated switch has its cathode connected to the gate of the main gated switch, its anode connected to a pilot power supply, and its gate connected to the trigger input terminal. The pilot power supply is connected between the anode of the pilot gated switch and the cathode of the main gated switch. This arrangement causes the anode side of the pilot power supply output potential to be raised as the main capacitor is discharged through the main gated switch, thus preventing the gate current to the main gated switch from reversing and turning off the main gate while the main capacitor is being discharged. Further, this arrangement allows the pilot gated switch to be connected directly to the gate of the main gated switch without the use of a pulse transformer as required in the prior art.

The pilot power supply may readily include a pilot capacitor, with one side connected through a charging resistor to the main capacitor and the other side connected to the output terminal. This allows the pilot capacitor to be charged as the main capacitor is charged.

To provide a lower level of charging voltage for the pilot capacitor as compared to the main capacitor, a voltage divider may be used. The voltage divider can be connected between the main capacitor and ground with an intermediate tap connected to the pilot capacitor. Any convenient path to ground, such as the ground terminal or through the primary winding of the ignition coil, may be used.

A bias circuit may be connected to a bias terminal, the trigger input terminal and the gate of the pilot SCR to provide a threshold voltage to be overcome by the trigger signal before triggering the pilot SCR. The bias circuit is particularly intended to maintain a substantially constant ignition angle relative to the position of the trigger coil for all engine speeds.

The ignition system of the invention may readily be packaged as an ignition module for firing one cylinder of a multi-cylinder engine. A bias input terminal connected to the bias signal means may be used to interconnect a plurality of such modules to assure uniform timing for the firing of the various cylinders.

BEST MODE FOR CARRYING OUT THE INVENTION

Figure 1:
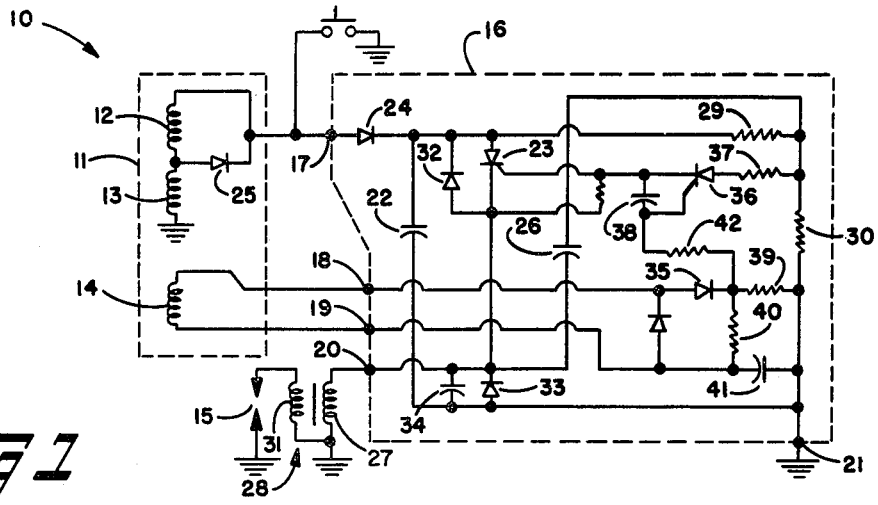
FIG. 1 schematically illustrates the ignition system of the invention as applied to a single cylinder engine.

Referring to the drawings and particularly to FIG. 1, an ignition system 10 for a single cylinder engine is shown. The ignition system 10 includes an engine driven flywheel alternator 11 having stationary low and high speed windings 12 and 13 and a trigger winding 14 which is moveable to provide spark angle control. The alternator 11 is connected to fire a spark plug 15 through an ignition module 16 having a stator input terminal 17, a trigger input terminal 18, a bias input terminal 19, an output terminal 20 and a ground terminal 21.

The ignition module 16 includes a main capacitor 22 connected to be charged by the alternator 11. A main gated switch 23 is connected to the main capacitor 22 to discharge the main capacitor 22 to fire the spark plug 15 in response to a timed trigger pulse from the trigger winding 14 magnetically coupled to the engine flywheel.

The alternator 11 includes a high speed winding 13 and a low speed winding 12 connected through a charging diode 24 to charge the main capacitor 22 to approximately 300 v. An additional diode 25 is provided to protect the low speed winding 12 from overvoltage when the voltage generated is of the polarity blocked by the charging diode 24. The alternator windings 12 and 13 are mounted on the engine and excited by magnets mounted on the engine flywheel as is well known in the art. Preferably, the additional diode 25 is mounted with the alternator windings to allow the system to operate with only one line leading from the alternator 11 to the stator input terminal 17 of the ignition module 16. The trigger winding 14 is energized by two trigger magnets, not illustrated, with each magnet spanning 180° on the engine flywheel to provide two magnetic polarity transitions on each revolution of the flywheel. The trigger winding 14 thus produces two voltage pulses of opposite polarity for each revolution.

A pilot power supply capacitor 26 for the triggering circuit is connected to be charged with the main capacitor 22. The pilot power supply capacitor 26 is connected to the output terminal 20 of the ignition module 16 and thus to ground through the primary winding 27 of the ingition transformer 28. A voltage divider network formed by resistors 29 and 30 reduces the voltage applied to the pilot power capacitor 26 to the desired level, normally about 65 v.

The main capacitor 22 is discharged through the primary winding 27 of the ignition transformer 28 to provide a high voltage pulse in the secondary winding 31 and thus fire the spark plug 15. The discharge pulse is controlled by a main gated switch 23, preferably a silicon controlled rectifier, which is turned on by a timed signal from the trigger winding 14. A protective diode 32, connected across the main SCR 23, prevents damage to the main SCR 23 should the spark plug 15 be inadvertently disconnected. A free-wheeling diode 33 is provided in the discharge circuit to extend the duration of the spark by providing a free-wheeling current flowing in the loop comprised of the primary winding 27 and diode 33. A capacitor 34 may also be provided to help absorb the very high frequency voltage transient generated by the spark discharge, and reflected into the ignition transformer's primary winding 27 by magnetic and electrostatic coupling. Thus, with the main capacitor 22 charged, firing of the main gated switch 23 results in the main capacitor 22 being rapidly discharged through the output terminal 20 of the ignition module to the ignition transformer 28, which transforms the voltage to a high level to fire the spark plug 15.

The main gated switch 23 is controlled in proper angularly timed relation to the engine's crankshaft by the output of the trigger winding 14. In particular, the trigger winding 14 is connected to the trigger input terminal 18 to supply positive polarity gate current through a diode 35 to the pilot gated switch 36, preferably an SCR. The pilot SCR 36, powered by the pilot power supply capacitor 26, then supplies a pulse of current to the gate of the main SCR 23 to turn on the main SCR 23 and thereby discharge the main capacitor 22. Because the primary winding 27 of the ignition transformer 28 is connected to the cathode of the main SCR 23, the cathode voltage rises rapidly as the main SCR 23 is turned on. To assure that gate current is continuously supplied to the main SCR 23 during the critical turn on period, a connection is provided between the cathode of the main SCR 23 and the negative terminal of the power supply capacitor 26 for the pilot SCR 36. As the main SCR 23 is turned on, the potential on both terminals of the power supply capacitor 26 is thus raised to assure a current flow through the pilot SCR 36 to the gate of the main SCR 23. Thus, damage to the main SCR 23 that could result from a cut off of gate current before the main SCR 23 is fully turned on is prevented.

To protect the pilot SCR's gate-cathode junction from damage a gate input resistor 42 and a gate-cathode suppressor capacitor 38 are provided. Together, they hold the gate-cathode current and reverse voltage to safe levels during the output pulse.

A biasing network connected through the bias input terminal 19 to the trigger winding 14 serves to maintain a substantially constant ignition angle relative to the position of the trigger winding 14 in the presence of variations in trigger voltage resulting from changes in engine speed. The biasing network is similar to that described in the present inventor's U.S. Pat. No. 4,015,564 and includes resistors 39 and 40, which form a voltage dividing network, and a bias capacitor 41. The bias capacitor 41 is negatively charged by the firing pulses from the trigger winding 14 to a level directly related to the engine speed. The bias capacitor 41 is connected to ground through the voltage dividing network. The junction between the resistors 39 and 40 of the voltage divider is connected to the gate of the pilot SCR 36 through a gate resistor 42 to provide a reverse bias voltage on the gate-cathode junction of the pilot SCR 36. This arrangement forces the trigger pulses to overcome the full bias voltage of the bias capacitor 41 before triggering the pilot SCR 36, while maintaining a lower level reverse bias on the gate of the pilot SCR 36 during the period between triggering pulses.

In operation, the main capacitor 22 and pilot power supply capacitor 26 are charged by pulses from the alternator windings 12 and 13. As the trigger magnet, not illustrated, passes the trigger winding 14, a trigger pulse will be generated which, after overcoming the bias from the bias capacitor 41, will fire the pilot SCR 36. The pilot SCR 36 then sends a gate current, safely limited by resistor 37, to the gate of the main SCR 23. When the main SCR 23 is thus fired it will discharge the main capacitor 22 through the primary winding 27 of the ignition transformer 28 to fire the spark plug 15. As the cathode voltage of the main SCR 23 rises during firing, that same voltage will be applied to the pilot power supply capacitor 26 to essentially maintain the voltage at the anode of the pilot SCR 36 above the cathode voltage of the main SCR 23, thus maintaining the flow of gate current into the gate of the main SCR 23 during the critical turn on portion of the firing pulse.

Figure 2:
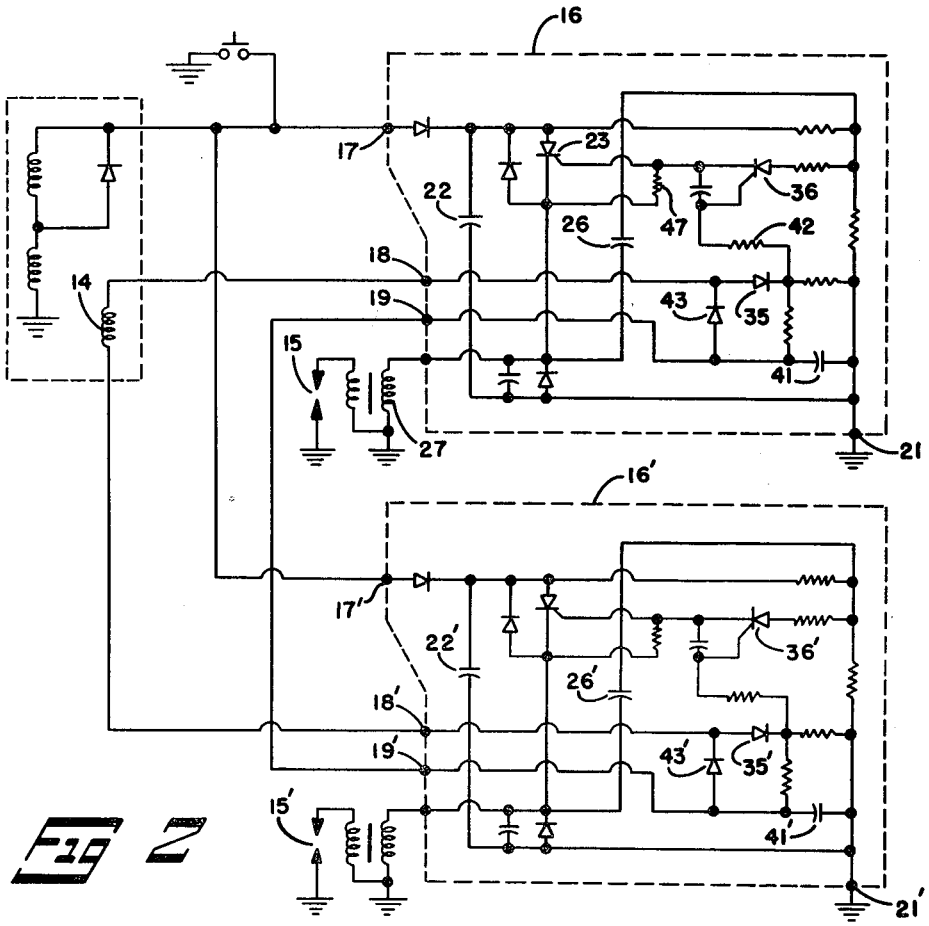
FIG. 2 schematically illustrates the ignition system as applied to a two cylinder engine.

FIG. 2 illustrates an ignition system having two ignition modules 16 and 16' identical to the module shown in FIG. 1 for firing the spark plugs 15 and 15' of a two cylinder engine. The stator input terminals 17 and 17' of the two ignition modules 16 and 16' are both connected to receive the alternator's output. Both of the main capacitors 22 and 22' will then be charged in the same manner as described in reference to FIG. 1. The trigger generator may be identical to that used for the one cylinder system described supra, but will have the opposite ends of the trigger winding 14 connected to the two trigger input terminals 18 and 18'. The two bias input terminals 19 and 19' are connected together.

In operation, with the main capacitors 22 and 22' and pilot power supply capacitors 26 and 26' charged as previously described, the trigger winding 14 will trigger the two ignition modules 16 and 16' to alternately fire the two spark plugs 15 and 15'. The diodes 35, 35', 43 and 43' form a steering network to alternately direct positive polarity trigger pulses to the two pilot SCR's 36 and 36'. The circuit which supplies trigger current to the pilot SCR 36 in the first ignition module 16 for the first spark plug 15 includes, in series, the ground connection 21', the bias capacitor 41', the diode 43' in the second ignition module, the trigger winding 14, the diode 35, the gate input resistor 42, the gate-cathode junction of the pilot SCR 36, the resistor 47 in the first igniton module 16, and the first ignition transformer's primary winding 27 with its ground connection. When the output of the trigger winding 14 reverses polarity, the trigger pulse current is directed in a corresponding manner to the gate of the pilot SCR 36' in the second ignition module 16'. Because the two bias terminals 19 and 19' are connected together the bias capacitors 41 and 41' are connected in parallel to act together to provide the same bias on the two ignition modules 16 and 16' to assure uniform timing of the two ignition circuits. Upon receiving its trigger pulse each of the ignition modules functions as previously described with reference to FIG. 1 to fire the spark plugs 15 and 15'.

Figure 3:
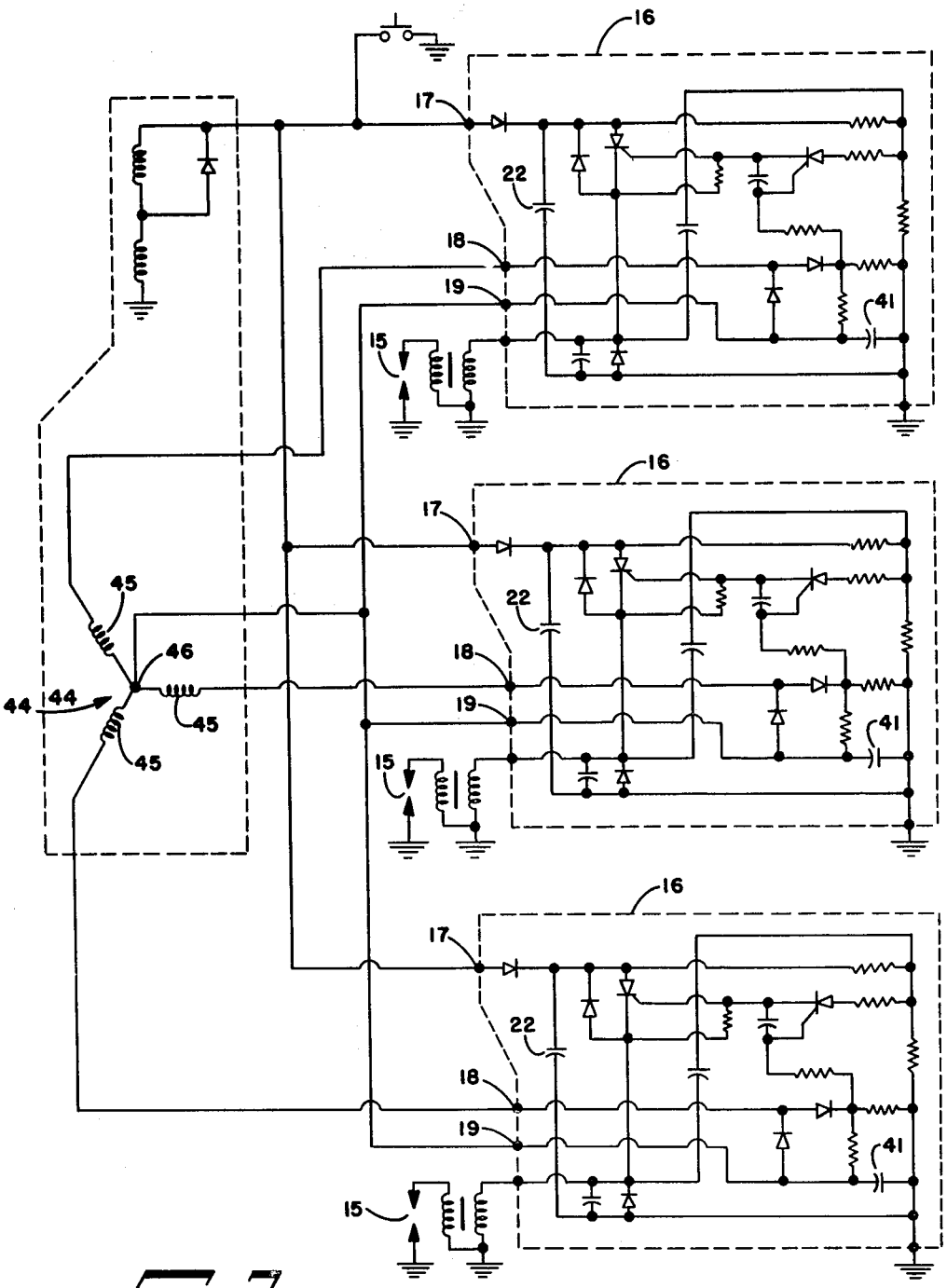
FIG. 3 schematically illustrates the ignition system as applied to a three cylinder engine.

FIG. 3 illustrates an ignition system for firing the spark plugs of a three cylinder engine. In this system three ignition modules are triggered from a trigger generator 44 having three windings 45 connected in a wye-connection. The central connection 46 of the trigger generator 44 is connected to the three bias input terminals 19 and the three trigger generator output terminals are connected to the three trigger input terminals 18 of the ignition modules. The three stator input terminals 17 are connected to the alternator output terminal to charge the main capacitors 22 in the same manner as previously described.

In operation, the system shown in FIG. 3 operates much like three single cylinder units. The trigger magnets, identical to those previously described, energize the three trigger windings 45 spaced 120° apart to provide positive polarity trigger pulses 120° apart. With the exception of the three bias capacitors 41 which are effectively connected in parallel to provide a uniform bias on the three pilot SCR's 36, the three modules function independently, as described in reference to FIG. 1, to fire the spark plugs 15.

Of course, as will be readily apparent to one skilled in the art, the ignition modules can be combined to provide ignition for four and six cylinder engines as well as those disclosed here.

The present invention thus provides ignition systems for a variety of engines which can be assembled using various combinations of identical ignition modules. The ignition modules are composed entirely of solid state components and may readily be mass produced.

I claim:

1. A capacitor discharge ignition system for use in an internal combustion engine comprising:

(A) a connection means having a stator input terminal, a trigger input terminal, a ground terminal, and an output terminal;

(B) a main capacitor connected between said stator input terminal and said ground terminal to be charged in response to a first specific polarity signal;

(C) a main gated switch connected between said capacitor and said output terminal to controllably discharge said capacitor into a load connected between said output terminal and ground, said main gated switch having an anode connected to said capacitor, a cathode connected to said output terminal, and a gate;

(D) a pilot gated switch having a cathode connected to the gate of said main gated switch, a gate connected to said trigger input terminal to receive a trigger signal, and an anode; and (E) a power supply connected between the cathode of said main gated switch and the anode of said pilot gated switch to raise the voltage of said power supply as said main gated switch discharges said main capacitor and maintain the voltage of said power supply above the voltage of the cathode of said main gated switch;

whereby gate current is supplied to said gate of said main gated switch as said main gated switch is turning on.

2. The ignition system defined in claim 1 wherein said power supply includes a pilot capacitor.

3. The ignition system defined in claim 2 wherein said pilot capacitor is connected between said main capacitor and said output terminal to be charged with said main capacitor.

4. The ignition system defined in claim 3 wherein said power supply further includes a voltage divider connected between said main capacitor and ground, said voltage divider having an intermediate tap connected to said pilot capacitor.

5. The ignition system defined in claim 4 further comprising a bias circuit means for establishing a threshold voltage to be overcome by said trigger signal before triggering said pilot gated switch.

6. The ignition system defined in claim 5 further comprising a bias input terminal connected to said bias circuit means.

7. A capacitor discharge ignition module for firing one cylinder of an internal combustion engine and suitable for use with other similar modules to fire the cylinders of multiple cylinder engines, said module comprising:

(A) a connection means having a stator input terminal, a trigger input terminal, a bias input terminal, a ground terminal, and an output terminal;

(B) a main capacitor connected between said stator input terminal and said ground terminal to be charged in response to a first specific polarity signal;

(C) a main gated switch connected between said main capacitor and said output terminal, to discharge said main capacitor into a load connected between said output terminal and ground, said main gated switch having an anode connected to said main capacitor, a cathode connected to said output terminal, and a gate;

(D) a pilot gated switch having a cathode connected to the gate of said main gated switch, a gate connected to receive a trigger signal from said trigger input terminal and an anode;

(E) a bias circuit connected to said trigger input terminal, said bias input terminal, said ground terminal, and said gate of said pilot gated switch to establish a threshold voltage to be overcome by said trigger signal before triggering said pilot gated switch and to provide a reverse bias on said gate of said pilot gated switch between trigger signals; and (F) a pilot supply capacitor connected between the cathode of said main gated switch and the anode of said pilot gated switch to raise the voltage of said pilot supply capacitor as said main gated switch discharges said main capacitor and maintain the voltage of said pilot supply capacitor above the voltage of the cathode of said main gated switch.

* * * * *